US006142800A

United States Patent [19]

Iwahori

[11] Patent Number: 6,142,800

[45] Date of Patent: Nov. 7, 2000

[54] LOW COUPLING FORCE CONNECTOR

[75] Inventor: Yoshihiro Iwahori, Shizuoka, Japan

[73] Assignee: Yazaki Corporation, Tokyo, Japan

[21] Appl. No.: 09/263,456

[22] Filed: Mar. 5, 1999

[30] Foreign Application Priority Data

Mar. 9, 1998 [JP] Japan ..... 10-057142

[51] Int. Cl.[7] ..... H01R 13/62

[52] U.S. Cl. ..... 439/157; 439/152

[58] Field of Search ..... 439/157, 151, 439/152, 342, 372

[56] References Cited

U.S. PATENT DOCUMENTS

| | | | |
|---|---|---|---|
| 5,595,492 | 1/1997 | Taguchi | 439/157 |
| 5,888,081 | 3/1999 | Konoya et al. | 439/157 |
| 5,919,053 | 6/1999 | Tsuji et al. | 439/157 |
| 5,928,012 | 7/1999 | Kitamura | 439/157 |
| 5,947,757 | 9/1999 | Ishii | 439/157 |
| 5,964,602 | 10/1999 | Aoki et al. | 439/157 |

FOREIGN PATENT DOCUMENTS 2-123681 5/1990 Japan .

*Primary Examiner*—Khiem Nguyen
*Assistant Examiner*—Son V. Nguyen
*Attorney, Agent, or Firm*—Armstrong, Westerman, Hattori, McLeland & Naughton

[57] ABSTRACT

A low coupling force connector consists of a connector body; a slider slidable on the connector body, having a first cam groove engageable with a first cam projection provided on a mating connector, the slider further having a second cam projection; and a lever rotatably supported on the connector body, which has at a point of action a second cam groove engageable with the second cam projection of the slider, whereby in coordination with rotation of the lever, the connectors are fitted to each other, wherein the second cam groove at the point of action of the lever is located close to a center of the slider in a direction perpendicular to a fitting direction of the connectors. The connector is easily and reliably couplable with the mating connector through operation of the lever.

5 Claims, 3 Drawing Sheets

LOW COUPLING FORCE CONNECTOR

BACKGROUND OF THE INVENTION

1. Field of the Invention

This invention relates to an electric connector used for connection of various cables, and more particularly to a low coupling force connector easily couplable with a mating connector through operation of a lever.

2. Description of the Related Art

As a connector which can be easily put and reliably maintained in a coupled condition with a mating connector, a lever-operated low coupling force connector has been proposed in Japanese Patent Application Unexamined Publication No. 2-123681, the connector being shown at X in FIG. 5, with its terminals and cable omitted for convenience' sake.

The connector X consists of a connector body a, a slider b received inside the connector body and a lever c. The slider b is provided with cam grooves e, e', e", each extending rearwardly downwardly, for engagement therein of respective cam projections d, d', d" of a mating connector Y.

The lever c is rotatable about a pivot f at its fulcrum as indicated by an arrow. The slider b has cam grooves h at its rear end, and the lever c has its point of action g engaged in the cam grooves h so that as the lever c is rotated about the pivot f in the direction indicated, the slider b moves forwardly, driving the cam projections d, d', d" downwardly along the respective cam grooves e, e', e". The mating connector Y is thus mated with the connector X, at which time their terminals are connected to each other.

This technique enables a connector to be coupled with a mating connector through simple operation of a lever, without requiring a large force, and is advantageously applicable especially to a connector large in size and incorporating lots of terminals.

With the conventional low coupling force connector, however, because the point of action g of the lever c is located at the end of the slider b, the force with which the cam grooves e, e', e" of the slider b act on the respective cam projections d, d', d" is not uniform and becomes smaller away from the point of action g, i.e., becomes smaller in this example in the order of e, e', ee", with the result that the intended sliding of the slider b and coupling of the connectors X and Y is sometimes not attainable by simple operation of the lever c. This drawback becomes prominent especially where the slider b tends to rattle in its sliding movement or with a large-sized connector. To cope with this drawback, connectors need be made of a material carefully selected, with an improved precision of parts and/or with a slider thickened and having an improved rigidity, resulting in the connectors becoming large-sized as a whole and costly in production.

SUMMARY OF THE INVENTION

This invention has been accomplished to overcome the above drawback and an object of this invention is to provide a low coupling force connector which can be easily and reliably coupled with a mating connector by operating its lever.

In order to attain the object, according to this invention, there is provided a low coupling force connector which comprises: a connector body; a slider provided slidably on the connector body, which has a first cam groove engageable with a first cam projection provided on a mating connector, the slider further having a second cam projection; and a lever supported on the connector body to be rotatable about a fulcrum thereof, the lever having at a point of action thereof a second cam groove engageable with the second cam projection of the slider, whereby in coordination with rotation of the lever, the connector and the mating connector are fitted to each other, wherein the second cam groove at the point of action of the lever is located at a position close to a center of the slider in a direction perpendicular to a fitting direction of the connector and the mating connector.

In the above low coupling force connector, because the point of action of the lever is located close to the center of the slider, the force of the lever will act relatively uniformly over the entire slider, enabling the slider to slide smoothly and the mating connector to be easily and reliably pulled into a mated condition with the connector to attain a reliable connection of their terminals.

Preferably, the slider is slidable on an innerside of a wall of the connector body and is covered as a whole by the wall before and after the connector is coupled with the mating connector.

Due to this feature by which the slider is as a whole accommodated inside the connector even before the connector is coupled with the mating connector, it is precluded that the slider may get damages by an external force during, for example, the coupling of the connectors, leading to a sound coupling of the connectors.

Preferably, lever includes a plate which, when the lever is mounted on the connector body, extends in the direction perpendicular to the connector-fitting direction and has the second cam groove at a distal end of the plate.

Preferably, two of the sliders are provided slidably at opposite sides of the connector body, and wherein the lever includes a pair of opposed plates which, when the lever is mounted on the connector body, extend in the direction perpendicular to the connector-fitting direction and have the respective second cam grooves at a distal end of the plates.

Preferably, the sliders are slidable on innersides of respective walls of the connector body and are covered as a whole by the respective walls before and after the connector is coupled with the mating connector.

The above and other objects, features and advantages of this invention will become apparent from the following description and the appended claims, taken in conjunction with the accompanying drawings.

BRIEF DESCRIPTION OF THE DRAWINGS

FIGS. 4A, 4B and 4C are plan views showing the process of coupling the low coupling force connector of FIG. 2 and the mating connector, of which FIG. 4A shows the connectors prior to their coupling, FIG. 4B shows the connectors in the process of being coupled to each other, and FIG. 4C shows the connectors in a coupled condition.

DESCRIPTION OF THE PREFERRED EMBODIMENT

An embodiment of this invention will now be described with reference to the attached drawings.

Figure 1:
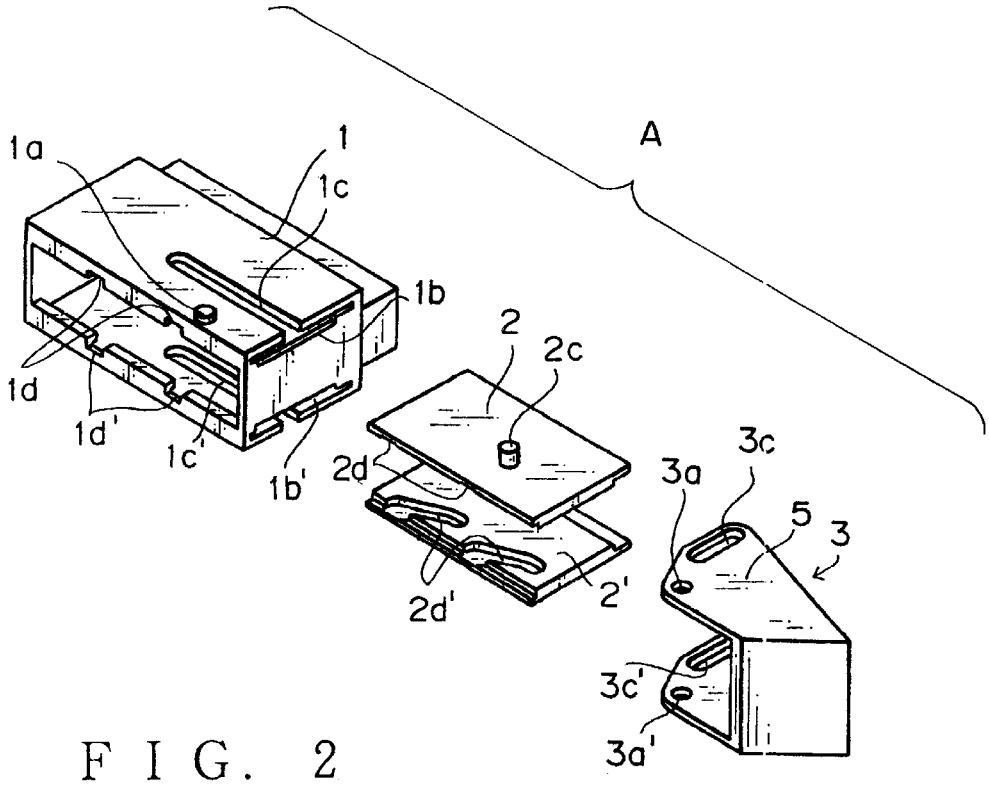
FIG. 1 is a perspective view of a low coupling force connector according to this invention, with its connector body, sliders and lever shown separated.

FIG. 1 shows a low coupling force connector A of this invention which includes a connector body 1, sliders 2, 2', and a lever 3. These are all formed of synthetic resin by injection molding.

The connector body 1 includes shafts 1*a* on its upper and lower walls (the one on the lower wall is not shown) for rotatably supporting the lever 3 thereabout, a pair of upper and lower slits 1*b*, 1*b*' on its side wall through which the sliders 2, 2' are received into the connector body 1, guide grooves 1*c*, 1*c*' for receipt of cam projections 2*c* provided on the respective sliders 2, 2' (the one on the slider 2' is not shown), and a pair of upper cutouts 1*d* and of lower cutouts 1*d*' for passage therethrough of cam projections 4*d* (FIG. 2) provided on upper and lower walls of a mating connector B (the ones on the lower wall are not shown).

The sliders 2, 2', which are in this example in mirror image relations to each other, include on their outer walls the respective cam projections 2*c* which engage in the guide grooves 1*c*, 1*c*' of the connector body and in cam grooves 3*c*, 3*c*' of the lever 3, and a pair of cam grooves 2*d* and of cam grooves 2*d*' provided on opposed inner surfaces of the sliders 2, 2' for sliding engagement therein of the respective cam projections 4*d* of the mating connector B. Each slider 2, 2' is slidable on the innerside of the respective upper or lower wall of the connector body 1, with the cam projection 2*c* slidingly engaged in the guide groove 1*c*, 1*c*', and is as a whole receivable inside the connector body in use or not in use. As is apparent from FIG. 1, the cam projections 2*c* are located at a center or near the center of the respective sliders 2, 2' in a width direction thereof (in a direction perpendicular to a fitting direction of the connectors A and B).

The lever 3 includes a pair of opposed plates 5 which, when the connector A is assembled, extend in the direction perpendicular to the fitting direction of the connectors A and B and hold the connector body 1 therebetween. The plates 5 each has at a distal end thereof a shaft-receiving hole 3*a*, 3*a*' fittable over the respective shaft 1*a* of the connector body 1 to rotatably support the lever 3 and the cam groove 3*c*, 3*c*' at a spacing from the shaft-receiving hole 3*a*, 3*a*' in which the respective cam projections 2*c* are engaged, as referred to above.

The lever 3 thus has a fulcrum at its shaft-receiving holes 3*a*, 3*a*' and a point of action at its cam grooves 3*c*, 3*c*', and because the cam grooves 3*c*, 3*c*' engage with the cam projections 2*c*, 2*c*' of the sliders 2, 2' to constitute a cam mechanism, the point of action of the lever 3 is located at or near the center of the sliders 2, 2'.

Figure 2:
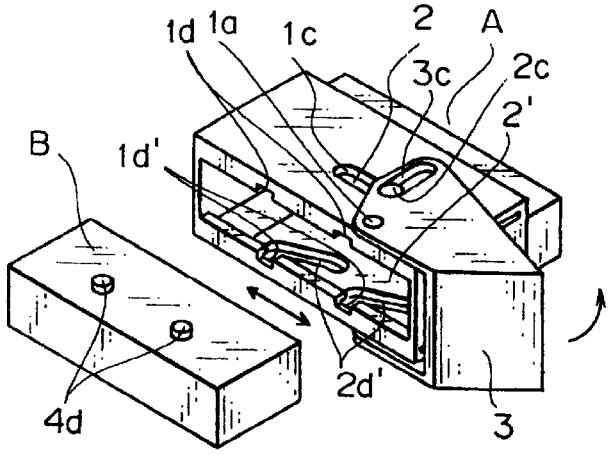
FIG. 2 is a perspective view of the low coupling force connector of FIG. 1, shown assembled and with a mating connector.
Figure 3:
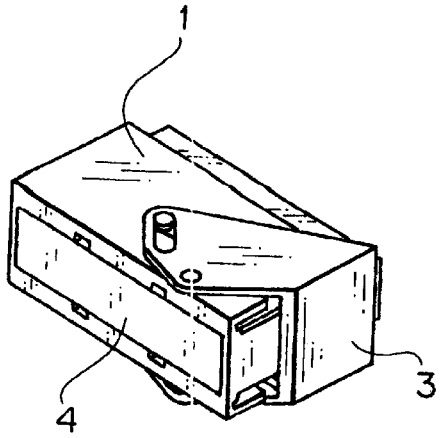
FIG. 3 is a perspective view of the low coupling force connector of FIG. 2, with the mating connector coupled thereto.

FIG. 2 shows the connector body 1, sliders 2, 2' and the lever 3 assembled into the low coupling force connector A of this invention. Denoted B is the mating connector.

The mating connector B is first received in a sub-assembled condition in the low coupling force connector A, with its upper and lower cam projections 4*d* passed through the respective cutouts 1*d*, 1*d*' into the respective cam grooves 2*d*, 2*d*' of the sliders 2, 2'. As the lever 3 is rotated in the direction indicated, the mating connector B is pulled at its upper and lower cam projections 4*d* and guided from the sub-assembled condition into a coupled condition with the connector A to be locked there.

In other words, the lever 3 is rotated about the shafts 1*a* to drive the cam projections 2*c*, which are engaged in the respective cam grooves 3*c*, 3*c*', along the guide grooves 1*c*, 1*c*' and thus the sliders 2, 2' in a reciprocatable manner as shown by a double-headed arrow in FIG. 2.

This movement of the sliders 2, 2' causes the mating connector B to move from the sub-assembled condition into the coupled condition and vice versa through the cam mechanism in which the cam projections 4*d* of the mating connector B are slidingly guided along the cam grooves 2*d*, 2*d*' to move the mating connector B in the connector-fitting direction.

It is to be noted here that, with the low coupling force connector A, not only in the sub-assembled condition but also in the coupled condition with the mating connector B, the sliders 2, 2' are fully received inside the connector body 1 and not exposed to the outside. This makes it possible to protect the sliders 2, 2' from accidental damages caused by an external force during, for example, the coupling operation of the connectors and secure a sound coupling between the connectors.

Figure 4A:
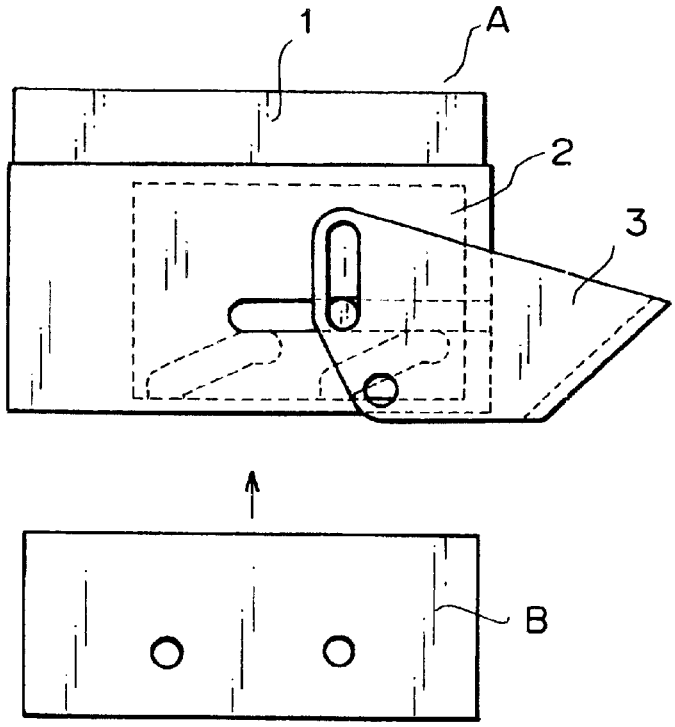

The operation of the low coupling force connector A will be described in more detail with reference to FIGS. 4A to 4C, which are top views of the connector A and the mating connector B, with the slider 2 inside the connector body 1 shown in a dotted line (FIG. 4A).

Figure 4B:
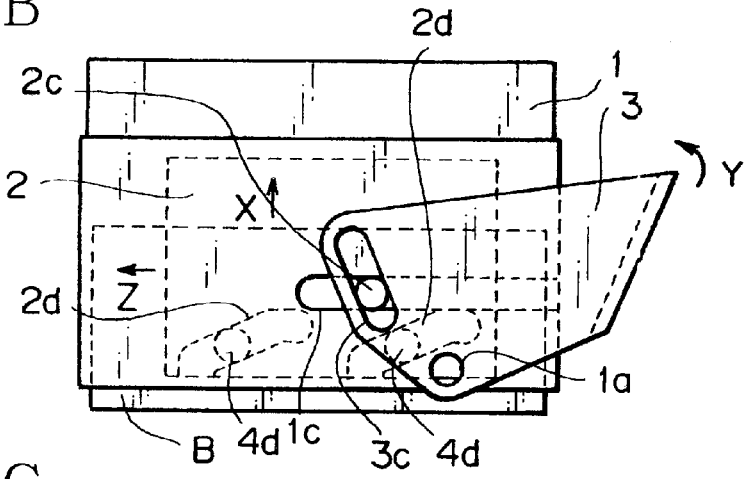

In FIG. 4B, a condition is shown in which the mating connector B has been moved in the connector-fitting direction X into the sub-assembled condition with the connector A, and then rotation of the lever 3 in the direction Y has been started.

The lever 3 rotates about the shafts 1*a*, at which time the cam projections 2*c* follow the movement of the respective cam grooves 3*c*, which are located at the point of action of the lever 3, while at the same time being confined in the guide grooves 1*c*, 1*c*', thereby moving the sliders 2, 2' in a leftward direction on the drawing. As the sliders 2, 2' are drived to the left, the cam projections 4*d* of the mating connector B are slid inwardly along the cam grooves 2*d*, 2*d*' to move the mating connector B in the fitting direction with the connector A and their terminals (not shown) into connection with each other.

In this instance, since the point of action of the lever 3 is located close to the center of the sliders 2, 2' in the width direction thereof, the force of the lever 3 acts uniformly on the sliders 2, 2', making it possible to move the mating connector B smoothly into a coupled condition with the connector A and their terminals into a reliable connection with each other.

Figure 4C:
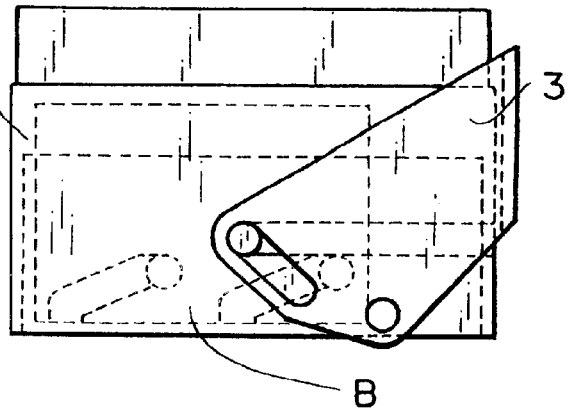
Figure 5:
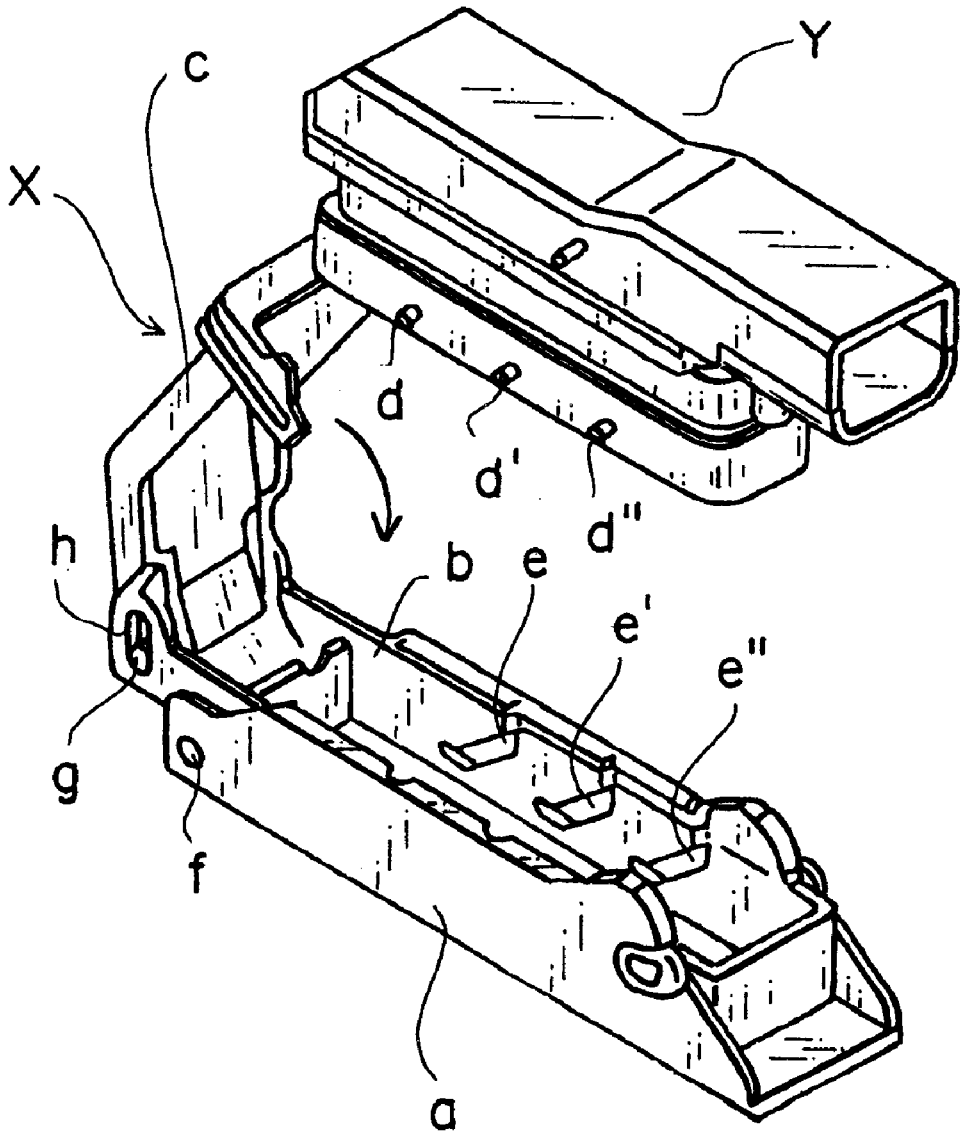
FIG. 5 PRIOR ART
FIG. 5 is a perspective view of a conventional low coupling force connector.

Then, the lever 3 arrives at the final position as shown in FIG. 4C to be locked there, at which time the coupling of the connectors A and B is completed. These connectors A and B will never be accidentally detached from each other without operating the lever 3.

As described hereinabove, the low coupling force connector according to this invention is easily couplable with a mating connector by one operation at the lever and is advantageously applicable in technical fields requiring a rapid and reliable connector connection such as the field of automobile assembly.

Having now fully described the invention, it will be apparent to one of ordinary skill in the art that many changes and modifications can be made thereto without departing from the spirit and scope of the invention as set forth herein.

What is claimed is:

1. A low coupling force connector comprising:

connector body;

a slider provided slidably on said connector body, which has a first cam groove engageable with a first cam projection provided on a mating connector, said slider further having a second cam projection; and a lever supported on said connector body to be rotatable about a fulcrum thereof, said lever having at a point of action thereof a second cam groove engageable with said second cam projection of said slider, whereby in coordination with rotation of said lever, said connector and said mating connector are fitted to each other, wherein said second cam groove at said point of action of said lever is located at a position close to a center of said slider in a direction perpendicular to a fitting direction of said connector and said mating connector.

2. The low coupling force connector according to claim 1, wherein said slider is slidable on an innerside of a wall of said connector body and is covered as a whole by said wall before and after said connector is coupled with said mating connector.

3. The low coupling force connector according to claim 1, wherein said lever includes a plate which, when said lever is mounted on said connector body, extends in said direction perpendicular to said connector-fitting direction and has said second cam groove at a distal end of said plate.

4. The low coupling force connector according to claim 1, wherein two of said sliders are provided slidably at opposite sides of said connector body, and wherein said lever includes a pair of opposed plates which, when said lever is mounted on said connector body, extend in said direction perpendicular to said connector-fitting direction and have said respective second cam grooves at a distal end of said plates.

5. The low coupling force connector according to claim 4, wherein said sliders are slidable on innersides of respective walls of said connector body and are covered as a whole by said respective walls before and after said connector is coupled with said mating connector.

* * * * *